US005524699A

United States Patent [19]

Cook

[11] Patent Number: 5,524,699

[45] Date of Patent: Jun. 11, 1996

[54] CONTINUOUS METAL MATRIX COMPOSITE CASTING

[75] Inventor: Arnold J. Cook, Mt. Pleasant, Pa.

[73] Assignee: PCC Composites, Inc., Pittsburgh, Pa.

[21] Appl. No.: 191,771

[22] Filed: Feb. 3, 1994

[51] Int. Cl.[6] ..... B22D 19/14; B22D 17/06; B22C 9/20

[52] U.S. Cl. ..... 164/97; 164/119; 164/306; 164/323

[58] Field of Search ..... 164/97, 119, 306, 164/900, 323, 130; 264/248, 246

[56] References Cited

U.S. PATENT DOCUMENTS

| | | | |
|---|---|---|---|
| 3,653,426 | 4/1972 | Groteke et al. | 164/119 |
| 3,998,365 | 12/1976 | Lethen et al. | 164/306 |
| 4,143,674 | 3/1979 | Portalier | 164/306 |
| 4,473,103 | 9/1984 | Kenney et al. | 164/900 |
| 4,749,019 | 6/1988 | Sorrell et al. | 164/323 |
| 4,759,995 | 7/1988 | Skibo et al. | 428/614 |
| 5,305,817 | 4/1994 | Borisov et al. | 164/97 |

FOREIGN PATENT DOCUMENTS

| | | | |
|---|---|---|---|
| 63-242462 | 10/1988 | Japan | 164/900 |

*Primary Examiner*—Richard K. Seidel
*Assistant Examiner*—I.-H. Lin
*Attorney, Agent, or Firm*—Ansel M. Schwartz

[57] ABSTRACT

A method and system for producing a continuous supply of low volume fraction composite material that can be fed continuously into one or more molds. Composite inputs are fed into a mixing device such that a continuous supply of mixed composite material is available from the output side of the mixing device. The operation removes the step of creating master ingots and removes the need for a two step process in which the material is melted twice. This invention reduces the cost of producing composite components, reduces batch-to-batch variations, and allows for a continuous production flow. In addition, the invention allows for a much greater flexibility in the selection and optimization of material systems.

27 Claims, 15 Drawing Sheets

CONTINUOUS METAL MATRIX COMPOSITE CASTING

FIELD OF THE INVENTION

The present invention is related in general to casting. More specifically, the present invention is related to the casting of metal matrix composites.

BACKGROUND OF THE INVENTION

Low volume fraction metal matrix composites are just beginning to gain market acceptance. Aluminum matrix composites with silicon carbide are now being used in a variety of applications. These materials provide higher stiffness and increased wear resistance and are being used to replace aluminum, steel, and cast iron components. Some of these components include extrusions, forgings, and castings for industrial and automotive applications. Components such as pump housings, brake rotors, engine blocks, cylinder liners, and bicycle frames are some of the current aluminum/silicon carbide composite applications.

Low volume fraction metal matrix composite materials are typically produced by one of three methods, all of which include producing an ingot of material which is solidified and later remelted and formed into a component. The three methods used to produce these ingots are stirring, powder metallurgy, and infiltration.

Aluminum low volume fraction composites are being produced by Duralcan and other companies by mixing silicon carbide particles in a crucible using a low-vortex stirrer as described in U.S. Pat. No. 4,865,806, incorporated by reference herein. As disclosed in this patent, the material is mixed in a crucible in an evacuated atmosphere between 15 minutes and 2 hours, and then the stirring head is replaced with a casting head. After the casting head has been put in place, the surface of the liquid metal is pressurized with a gas to force the liquid composite mixture into a water-cooled ingot mold. Later the ingot is remelted and restirred and cast in the shape of a component.

This is a batch-type operation which requires stopping and opening the mixing machine at various times during the mixing to scrape reinforcement off the side walls and to switch heads. All the material must be mixed first. Then the mixing is stopped and ingots are formed, the mixed material is used up, and a new batch is made. In this process, the size of the batch is controlled by the size of the crucible. Typically, 100 lbs. or less of material is produced per batch due to the difficulty in uniformly mixing large volumes of material.

An alternative method used to produce composite ingots is powder metallurgy. For example, powder aluminum can be mixed with silicon carbide particulate and then cold and/or hot pressed to form an ingot. This method is currently being used by Alcoa and DWA, Inc. to produce low volume fraction composite ingots. These ingots may then be extruded or remelted for casting.

In the infiltration method to produce composite ingots, different processes, including gas pressure infiltration and pressureless infiltration, may be used a number of different ways to create a composite ingot. Infiltration can be used to create a highly loaded composite ingot which can be diluted in a melt to the desired particle loading. An alternative method is to infiltrate the reinforcement located in the bottom of a crucible and then stir the melt to cause the infiltrated reinforcement to disperse.

All of the current methods of producing low volume fraction metal matrix composite components involve first creating solidified low volume fraction ingots in a batch process, remelting them, and then forming a component. Typically, after solidification and formation of a composite ingot, the composite ingots are then remelted in a crucible and stirred to keep the reinforcement dispersed. The material is then cast into a mold to produce one or more components. After the crucible of material is spent, the casting process is stopped, and a new batch is made by melting additional composite ingots.

This batch-type process requires a large amount of labor and equipment to produce low or medium volumes of components. This process is not ideally suited for high volume continuous component production. Also, the two heating cycles, one to produce the composite ingot, and the other to reheat and cast, requires a high energy consumption, especially in the case of aluminum, which has a high heat of fusion. Current processes are therefore expensive due to the high energy consumption and too slow for mass production due to the batching operations required. Also, only a few materials are available from suppliers which gives the component producer little flexibility in choice of material systems.

SUMMARY OF THE INVENTION

The present invention is a method and system for producing a continuous supply of low volume fraction castable composite material and for forming components directly without the interim step of forming an ingot. The process can be used on a wide variety of composite systems and allows in-process system modification. By mixing liquid metal and reinforcement in a continuous process instead of a batch process, a single continuous output supply can be attained. Further, the invention requires that the matrix material, such as a metal be melted only once. When the metal reaches the correct liquid temperature, reinforcement is distributed uniformly throughout the liquid metal in a mixing device and cast directly into the shape of a component. This process can be monitored and optimized by adjusting the inputs during casting as part of an on-line process. The process also provides the lowest cost and highest flexibility because users can tailor the material system on-line to optimize specific properties. Further, users can buy the lowest cost raw materials and combine them directly to produce components without going through secondary operations or suppliers. The system can be used to produce a wide variety of different composite systems with different materials, different metals, different additives, and different reinforcements. Users are not limited to the one or two materials such as aluminum/silicon carbide available from the current suppliers. With this process and system, it is just as easy to make magnesium, iron, or polymer composite components with a wide variety of reinforcements and loading levels.

The invention allows for the direct metered input of raw materials, the capability to mix those materials together, and then produce a continuous supply of castable material for direct high volume component production. In this invention, the material is only heated once above the matrix melting temperature resulting in the lowest cost composite system with minimum interaction between matrix and reinforcement, minimal loss of alloying additions to the atmosphere, and minimum segregation of the reinforcement in the matrix.

BRIEF DESCRIPTION OF DRAWINGS

In the accompanying drawings the preferred embodiment of the invention and the preferred methods of practicing the invention are illustrated in which.

DESCRIPTION OF THE PREFERRED EMBODIMENT

Figure 1:
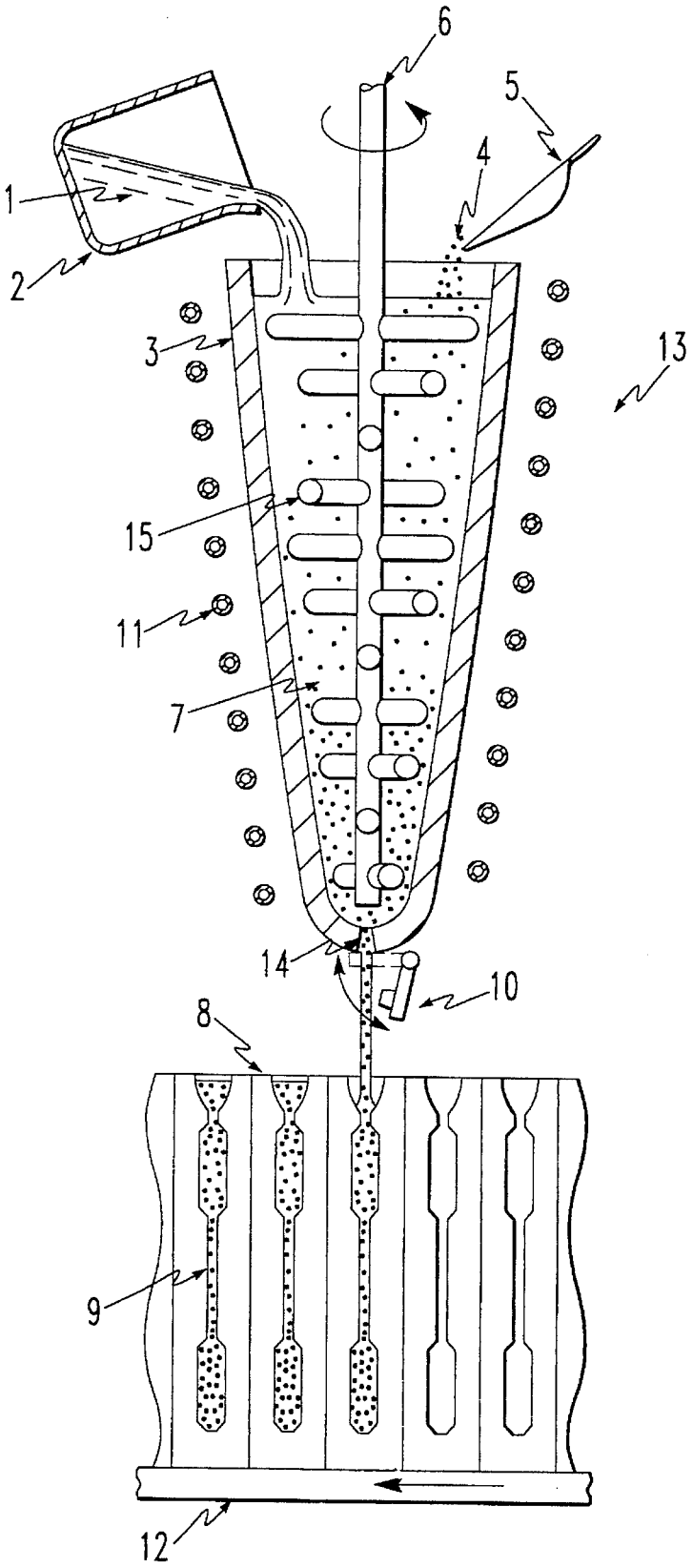
FIG. 1 is a schematic representation showing a continuous output composite material mixer feeding low volume fraction composite material into casting molds.

Referring now to the drawings herein like reference numerals refer to similar or identical parts throughout several views, and more specifically to FIG. 1 thereof, there is shown a cross-section of a continuous mixer device 13. Liquid metal 1 is supplied from a matrix reservoir 2 into a mixing container 3. Reinforcement material 4 is supplied from a reinforcement reservoir 5 in metered amounts into the mixing container 3. A low-vortex zone stirring mechanism 6 is used to distribute the reinforcement 4 into the liquid metal 1. As material flows downward through the mixing container 3 the reinforcement 4 becomes uniformly distributed by the time it reaches the bottom. Uniformly mixed composite material 7 flows out of the mixing container 3 and directly into the mold 8 to form a net shape composite component 9. The net shape composite component 9 is a component whose shape is used as cast without remelting the matrix for an application. A net-shape component, as known in the art, differs from an ingot in that an ingot is a round or square chunk and is used as raw material whereas a net-shape component has a specific shape.

Flow of the composite material 7 may be disrupted or controlled by a valve or stopper 10. Single or multi-zone heating elements 11 may be used to control the temperature of the composite material 7 as it moves through the continuous mixing container 3. The stirrer 6 preferably has individual paddles or blades 15 which serve to mix the composite material 7 in that area, but do not force material up or down, or create any vortexes. Material is drawn down through the container 3 as it is used. The output and inputs are controlled so that the appropriate mixing time occurs to achieve uniform mixing. Raw materials are put in such as metal 1 and reinforcement 4 to match the output so that the proper amount of composite material 7 is maintained in the mixing container 3. Raw material inputs of metal 1 and reinforcement 4 may be batch or continuously supplied. Input of raw materials may also be based on the volume used in filling molds 8 with a given part 9 volume. Inputs may also be determined by the material level in the container 3, the weight of the container 3, and/or the amount of time flow occurs with the plug 10 open. Molds 8 may be located on a conveyor 12 to move the molds 8 in position under the outlet 14 of the mixing container 3. Alternatively, the mixing crucible 3 may be moved to position it over the molds 8. The output of the mixing crucible may also be fed into a holding reservoir, pressure caster, pouring crucible, extruder, die casting machine, or squeeze casting machine as will be described.

Figure 2:
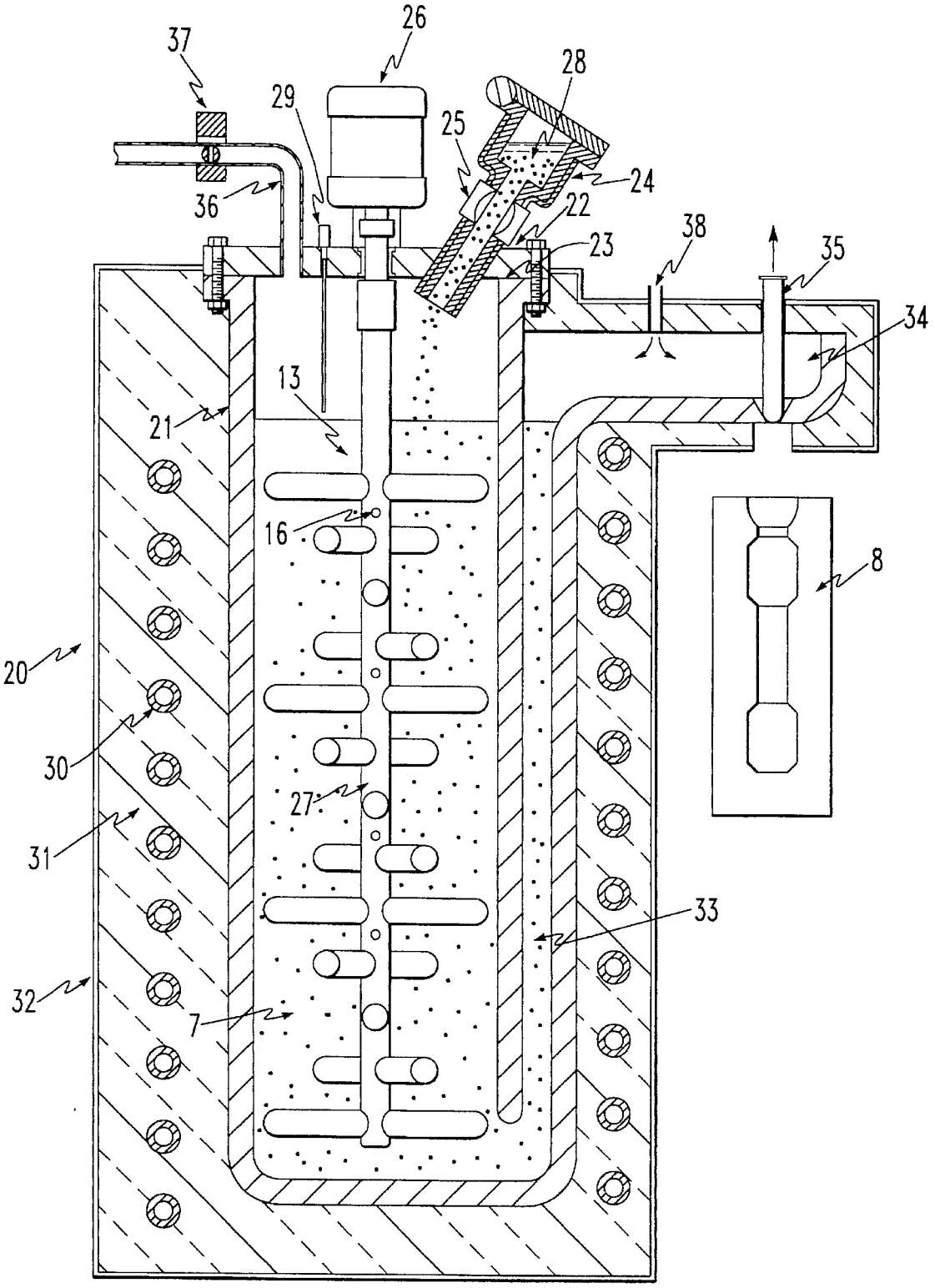
FIG. 2 is a schematic representation showing a pressure caster with a continuous mixing system.

FIG. 2 shows a cross section of a pressure caster 20 with continuous composite mixing mechanism 13. Column 21 has a cover 22 and a seal 23 such that the internal area may be pressurized through a supply line 36. Gas may be controlled through control valve 37. The cover 22 has a mixing motor 26 attached to a mixing blade 27 such that inputs 28 of metal 1 and reinforcement 4 can be metered through a control valve 25 into the mixing column 21. The pressure caster 20 may also include a level sensor 29 to monitor the-level of material inside the column 21 such that additional inputs 28 may be added as required. A number of inputs 28 may be fed through individual input ports 24. These input ports 24 can supply metered amounts of inputs 28 such as metal 1, ceramic reinforcement 4, or additives such as silicon or magnesium to produce the desired alloy and composite composition. Inputs 28 may be solid material or liquid of one or more types. Inputs 28 may be computer controlled for feeding in the appropriate amount of each input 28 to get the desired uniformly mixed composite 7. By tying and monitoring the output of the pressure caster 20 to the inputs 28, the inputs 28 can be automatically adjusted to achieve a desired result, such as continuous supply of a specific alloy, loading level, etc. This continuous supply of composite casting material has many advantages over previous batch-type processes which necessitated stopping and reloading.

The pressure caster 20 includes heating elements 30 which control the temperature within the mixing column 21 such that the matrix 1 is maintained at the desired temperature. Single or multi-zone heating may be used. The heating may be done with induction coils or resistive elements. Preferably, the heating elements 30 are copper water-cooled induction coils and the mixing column 21 is a graphite susceptor. The outer portion of the pressure casting vessel 20 has a metal protective cover 32 which helps to hold insulation 31 around the coils 30 and mixing column 21. The pressure caster has a supply Channel 33 emanating from the bottom and feeding a reservoir 34. The reservoir 34 includes a plunger 35 which can be lifted to allow the composite mixture 7 to flow into a mold 8. A vacuum may be pulled inside the mixing column 21 by removing gases through supply line 36. Nitrogen or other gases may be bubbled through the composite material mixture 7 to remove trapped or dissolved gases. For instance, nitrogen may be blown through the stirring rod 27. A hollow stirring rod 27 may be used and holes 16 may be located in the rod 27 to feed gas bubbles into the mix at desired locations. In addition, a separate tube may be fed into the composite mixture to supply gas. Gas may also be supplied through a cover gas inlet 38 and pulled through the feeder channel 33 by use of a vacuum within the mixing column 21.

Figure 3:
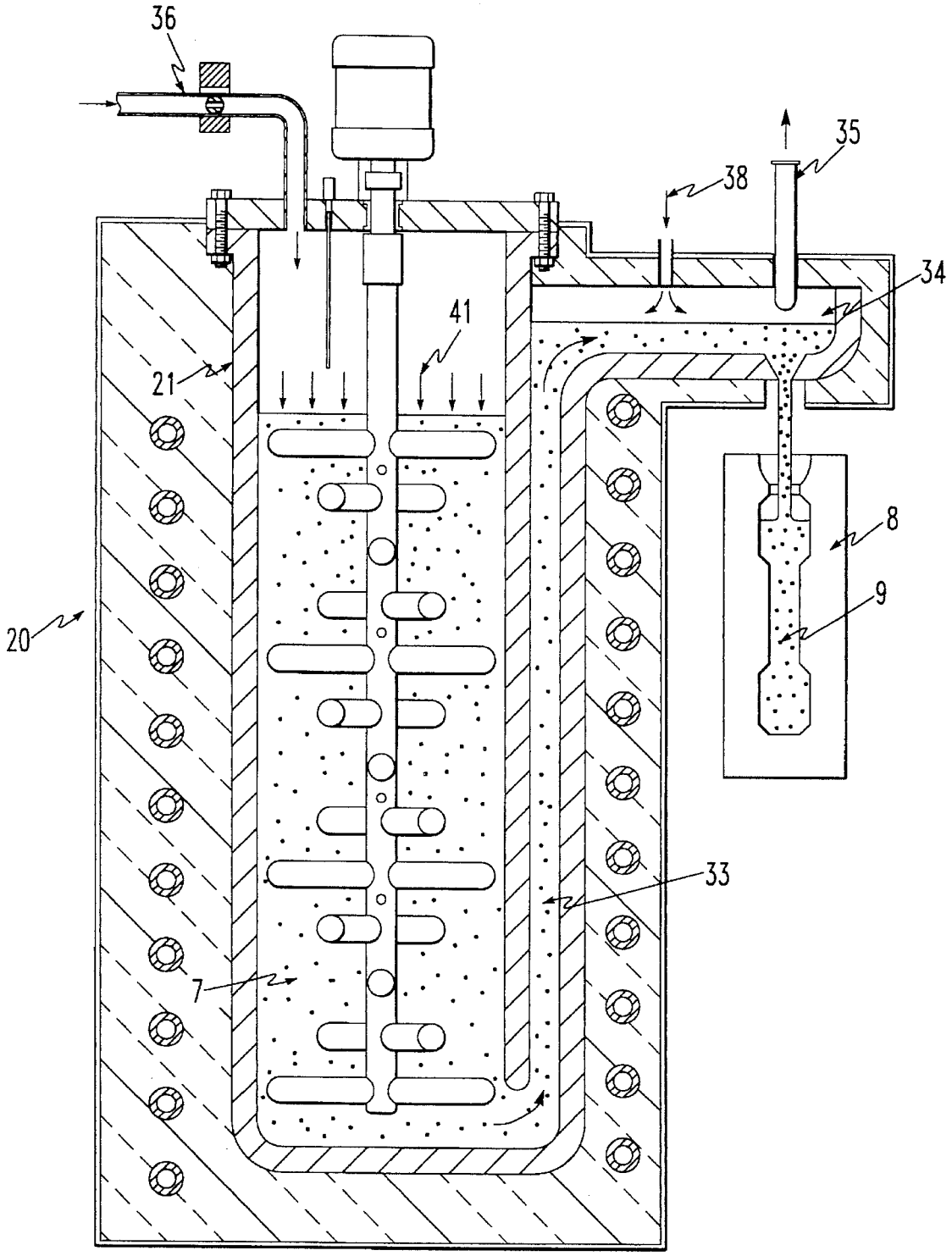
FIG. 3 is a schematic representation showing a pressure caster with a continuous mixing system supplying material into a mold.

FIG. 3 shows the pressure caster 20 being used to cast a component 9 within a mold 8. Uniformly mixed composite material 7 is forced out of the mixing column 21 through the feeder channel 33 by gas pressure supplied through line 36. Gas 41 acts on the surface of the composite mixture 7 such that it is forced out the feeder channel 33 into the reservoir 34. A cover gas supplied through inlet 38 may be used to keep the composite material 7 in the reservoir 34 from oxidizing. Plunger 35 is lifted such that the composite mixture 7 can flow into the mold 8 to form a component 9. Once the mold 8 is filled, the plunger 35 is lowered to stop the flow, then the pressure is removed through supply line 36 which causes the composite material 7 in the reservoir 34 to flow back into the feeder channel 33.

The output of the pressure caster 20 may be fed directly into a mold 8 or into another forming apparatus, such as a continuous casting die, a vacuum or die caster, squeeze caster, pelletizer, or extrusion machine. The pressure within the mixing column 21 may be used to feed mixed composite material 7 directly into a mold 8, thus utilizing the pressure to help form and densify the component 9. Alternatively, the gas pressure may be used to feed a reservoir and then gravity is used to feed material into a mold 8. Pressure caster 20 may be enclosed inside of a vacuum or pressure vessel. By pulling a vacuum on the encapsulating vessel, an evacuated state may be created inside the composite material 7 and the mixing column 21. By placing a gas such as nitrogen inside the encapsulating vessel, this gas may be pulled through the composite mixture 7 by lowering the pressure in the mixing column 21 through inlet 36.

Figure 4A:
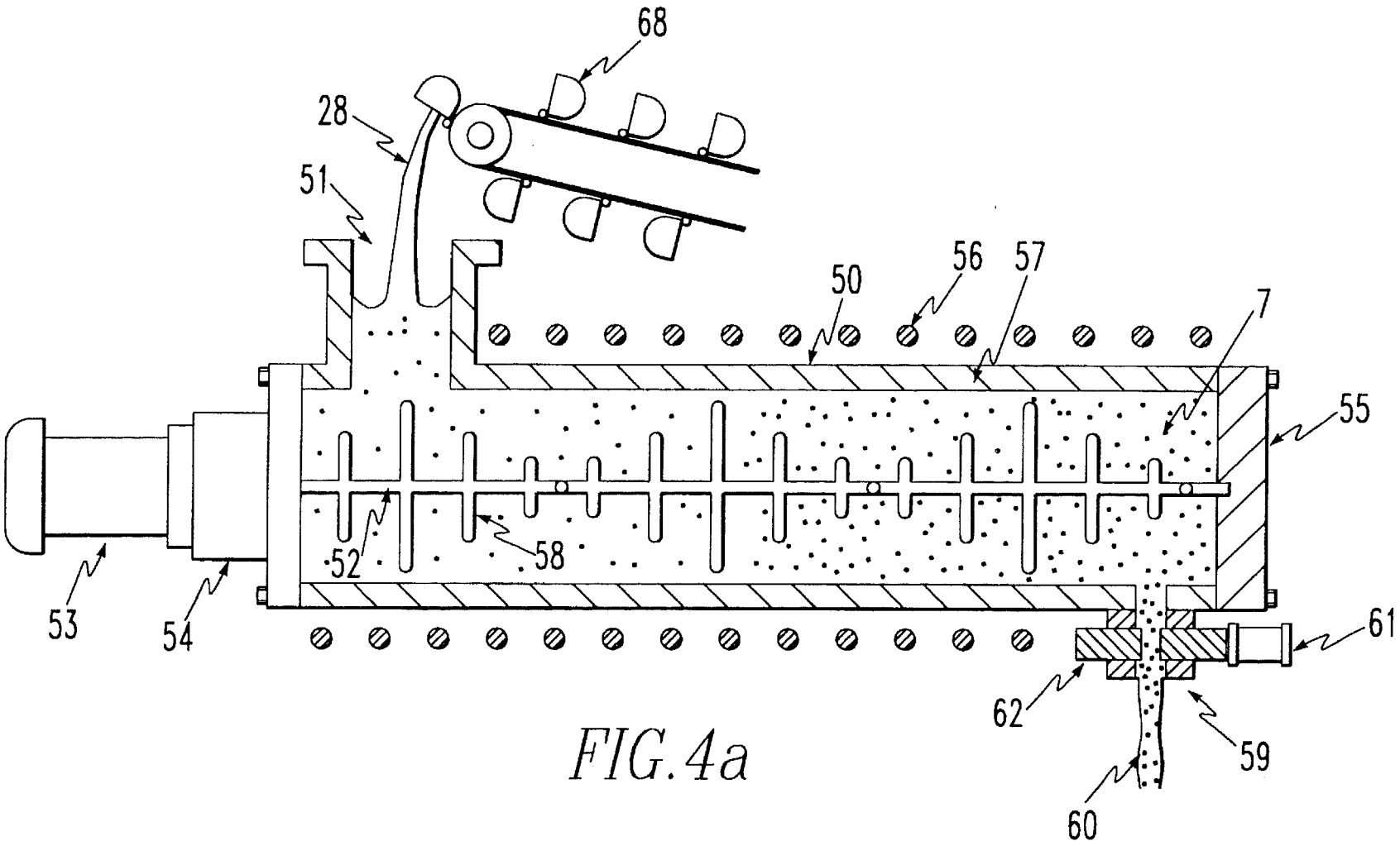
FIGS. 4*a* and 4*b* are schematic representations showing continuous horizontal and angled mixers, respectively.

FIG. 4*a* shows a cross section of a horizontal mixing chamber 50 in which inputs 28 of matrix 1 and reinforcement 4 are loaded into the feed end 51. The stirring rod 52 is connected to a stirring motor 53 which goes through an insulating and sealing block 54. The opposite end of the stirring rod 52 is supported by a bearing block 55. Heating elements 56 are used to control the temperature inside the mixing chamber 57. The stirring rod 52 keeps the particles suspended, and by using different designs of stirring blades 58, the composite material 7 can be moved towards the output end 59. As the composite material 7 moves through the mixing chamber 57 the reinforcement 4 becomes uniformly dispersed. The composite material output 60 may be controlled by a control valve 61 which uses a piston to align a hole in a graphite or ceramic rod 62 such that composite material 7 can flow out of the mixing chamber 57. By metering the output 60, inputs 28 can be adjusted such that a desired volume is maintained inside the mixing chamber 57. Input feed system 63 can comprise a conveyer feed system which loads controlled volumes of inputs 28 into the mixing chamber 57. Many different input metering systems are available to feed a desired volume into the mixing chamber 57.

Figure 4B:
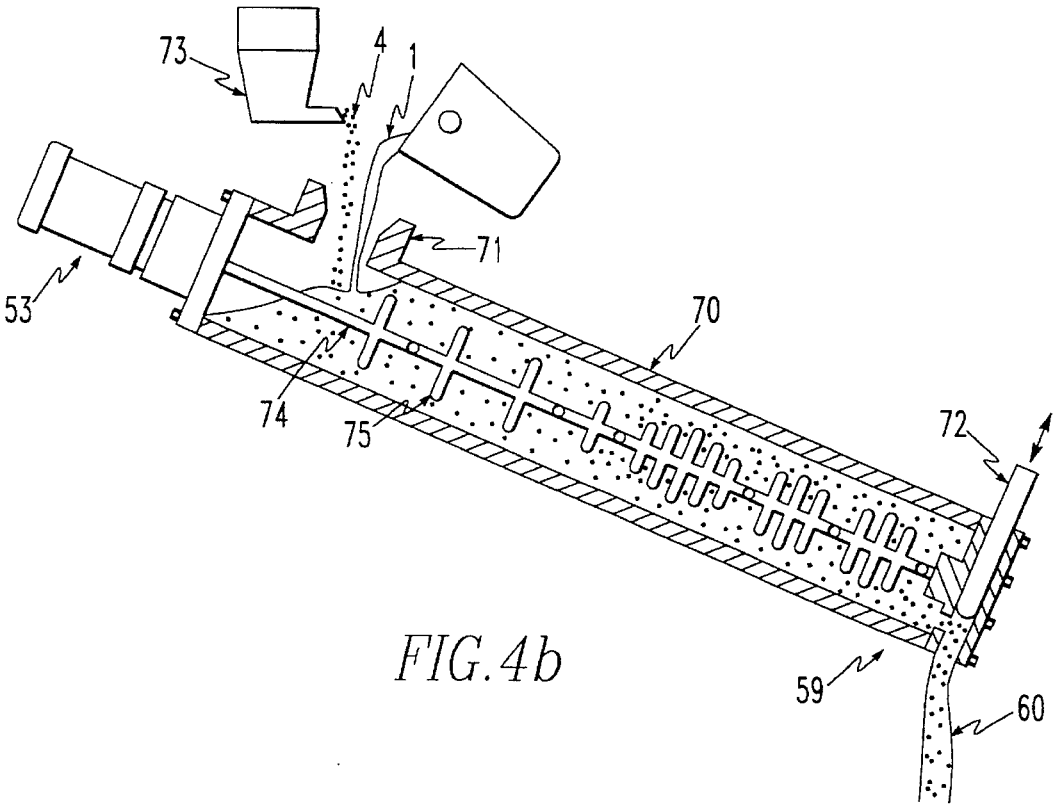

FIG. 4*b* shows an angled mixing system 70 in which the volume of material is kept below the fill port 71 such that the stirring motor 53 does not need to be sealed. Angled mixing chamber 70 has a plunger 72 for controlling the output 60. Liquid metal 1 is being fed into the angled mixing chamber 70 along with reinforcement 4. A controlled output vibratory feeder 73 can be used to supply the desired amount of reinforcement 4. Liquid or solid metal 1 or other matrix materials may be fed into the angled mixing chamber 70. A ceramic or ceramic coated stirring rod 74 may include different stirring blades 75 at increasing frequency towards the output end 59 such that the material 7 becomes more uniformly mixed as it progresses down through the angled mixing chamber 70. This type of design minimizes the entrapment of gas by minimizing the vortexes created near the surface where the inputs are placed. Mixing speeds between 50 and 2500 rpm are effective in distributing particulate reinforcement 4 throughout the matrix 1. Material output 60 is controlled such that material inside the mixing chamber 70 has the required amount of time to mix thoroughly before exiting the angled mixing chamber 70 between 5 minutes and 2 hours. The chamber length may be designed to provide a given output volume per hour. Mixing chambers of less than 12" in diameter are preferred to keep material uniformly mixed. Multiple mixing chambers may be used, if required, to fulfill a continuous supply requirement.

Figure 5A:
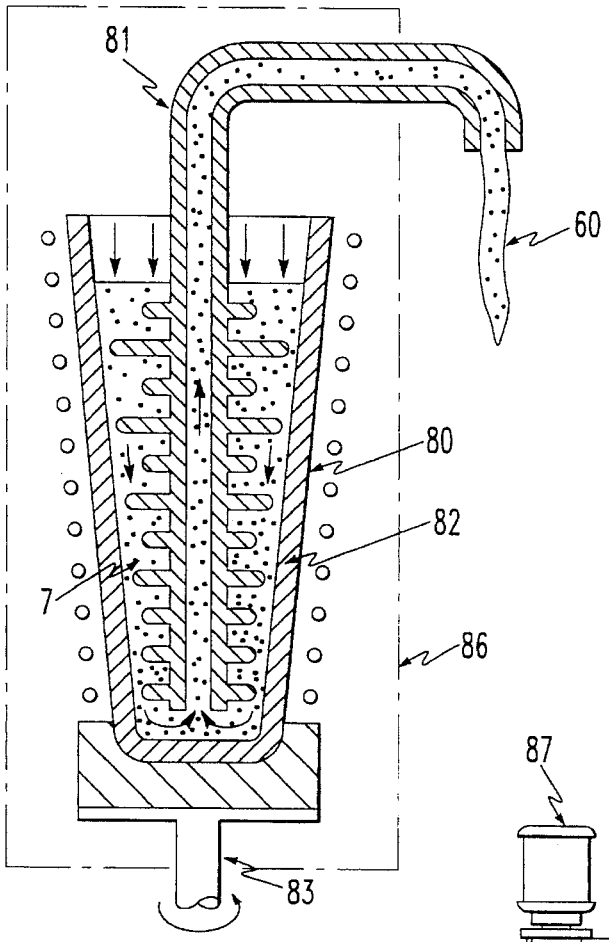
FIGS. 5*a* and 5*b* are schematic representations showing continuous mixing devices with metal feeding through the stirring blades.

FIG. 5*a* shows a mixing apparatus 80 in which a hollow, stationary stirring rod 81 is used in conjunction with a rotating mixing column 82. The mixing column 82 is connected to a shaft 83 which is driven by a motor (not shown). The rotating mixing column 82 causes the material 7 to be mixed as it flows downward. By enclosing the system in a pressure vessel 86, the surface of the mixed composite material 7 may be forced downward such that the material 7 flows through the stationary stirrer 81 as composite output 60. This apparatus 80 can be used to provide a continuous supply of low volume fraction composite material since inputs 28 may be added while output 60 is removed.

Figure 5B:
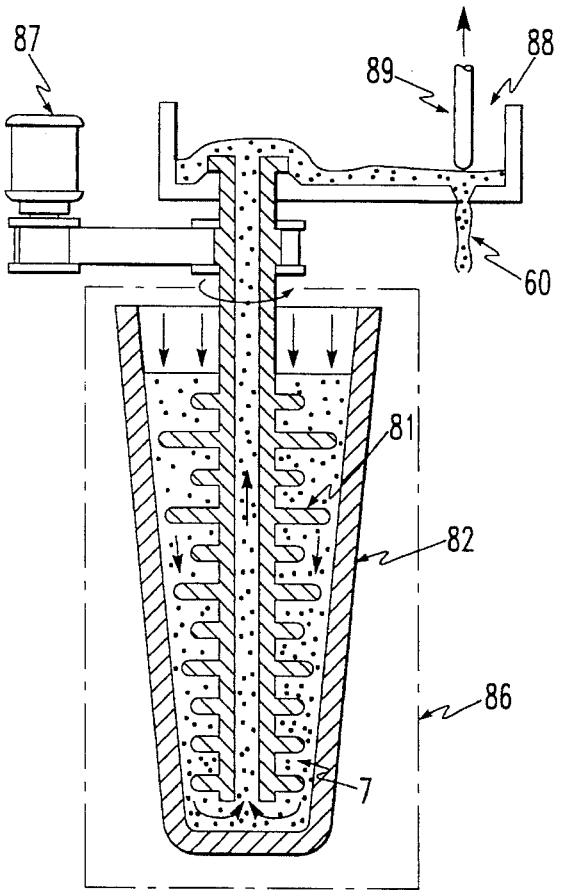

FIG. 5*b* shows another embodiment in which the mixing column 82 is stationary, and the hollow stirrer 81 is rotated by a motor and drive 87 such that inputs are mixed into an uniform composite 7 as they flow through the mixing column 82. The mixing column 82 may be enclosed in a pressure vessel 86 such that when the vessel 86 is pressurized, the mixed composite 7 flows into a reservoir 88 with a plunger 89 for controlling low volume fraction composite output 60.

Figure 6A:
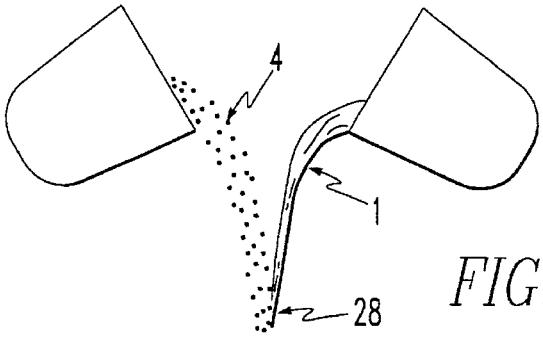
FIGS. 6*a*–6*c* are schematic representations showing various forms of input materials.
Figure 6B:
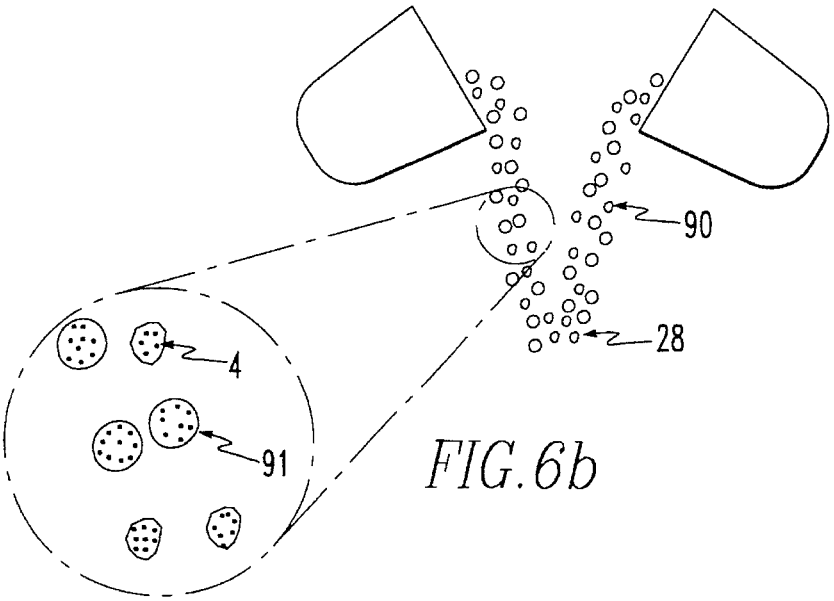
Figure 6C:
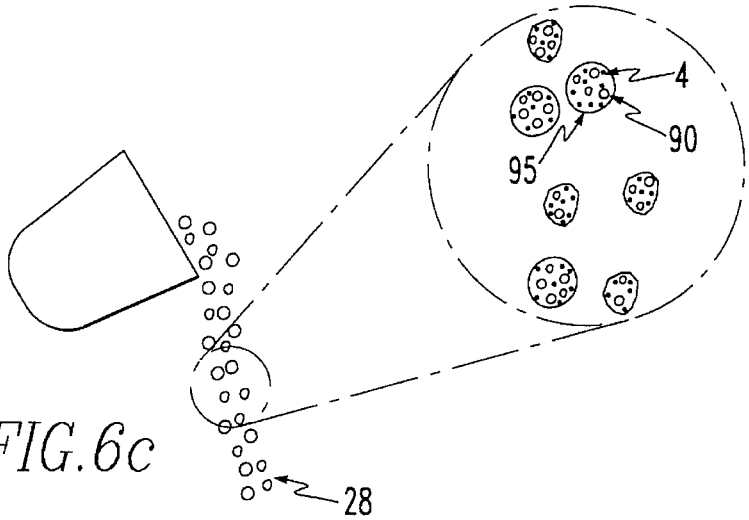

FIGS. 6*a*, 6*b*, and 6*c* are schematic representations of the different forms that input materials 28 may take. FIG. 6*a* shows particulates of reinforcement 4 being added with liquid matrix material 1. Particulate material 4 may be reinforcement or alloying additions to liquid matrix material 1.

FIG. 6*b* shows solid matrix material 90 being used as an input 28 along with agglomerates or clusters of reinforcement 91. Clusters 91 can be easier to mix into the melted matrix material 1. After the clusters 91 are mixed in, the clusters 91 may be broken up such that the individual particles in the clusters 91 are distributed uniformly in the matrix 1. This system of clustered particles 91 is valuable in applications where the particles tend to lay on the surface of the liquid matrix 1 and have difficulty going into the mixture 7. Clusters 91 may be formed by a variety of methods, including spray drying, pressing, and extrusion with pelletization or spheration. All of these processes are accomplished by mixing the reinforcement particulates 4 with a binder, such as wax, to hold the particles together. Other additives, such as silica, may be used to hold the particles together once the wax is removed. Clusters 91 may include additions other than reinforcement, such as fluxes or alloying additions which may aid in the dispersion of the reinforcement and creating the desired liquid matrix composition 1.

FIG. 6*c* shows input pellets 95 made up of a mixture of solid matrix material 90 and particulate reinforcement material 4. The pellets 95 are premixed to the desired concentration of each additive so that separate metering of the solid matrix material 90 and particulate reinforcement material into the mixing system is not required. Pellets 95 may be easily mixed and dispersed. Pellets 95 may be formed by co-spraying, pressing, and other operations, some of which involve using wax binders and/or heating to cause the pellets to hold together to be used as an input 28. The input pellets 95 may also be premade pieces of mixed composite material 7.

Figure 7B:
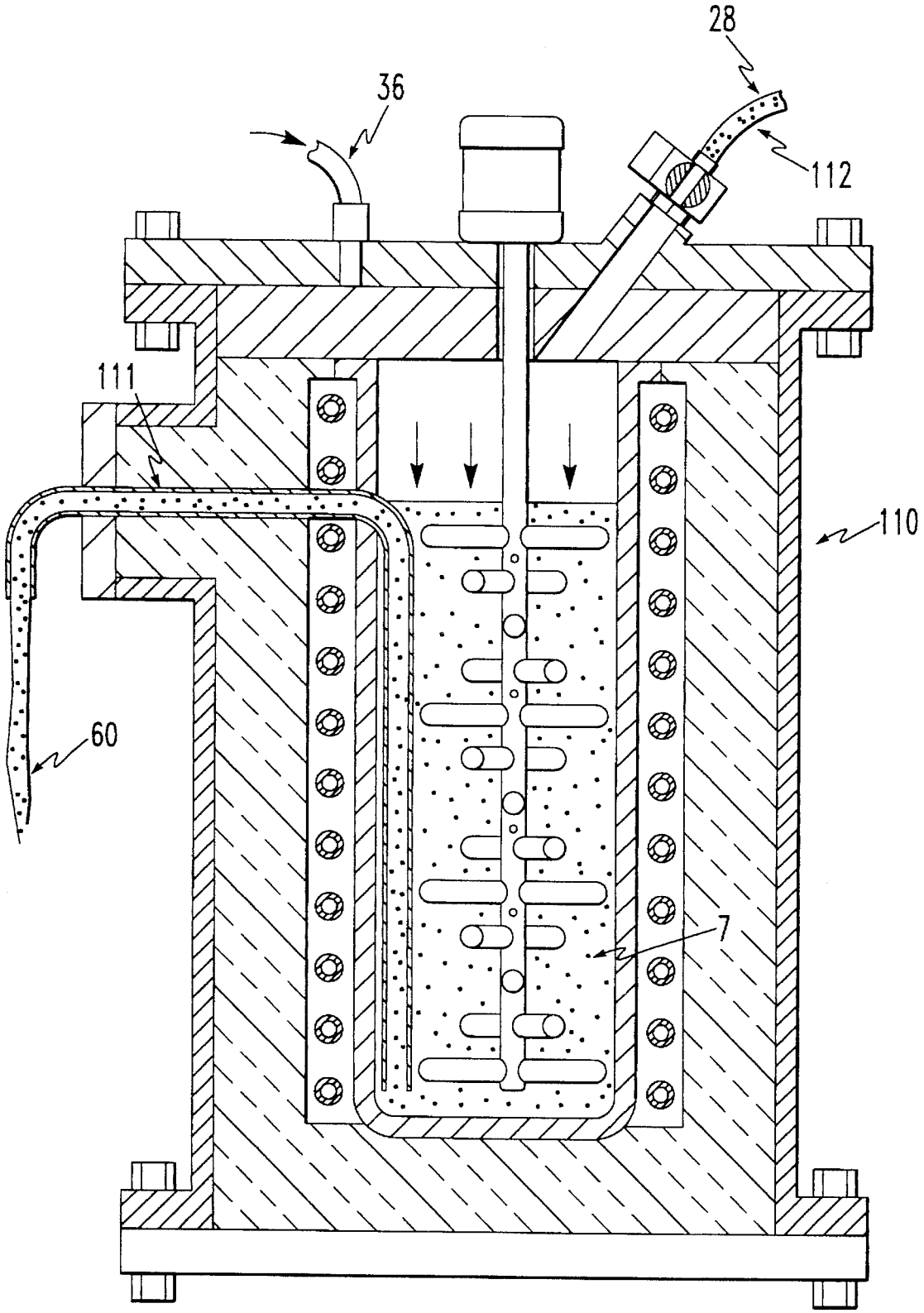
FIGS. 7*a*–7*d* are schematic representations showing different continuous mixing and supply systems and a reservoir for filling castings.
Figure 7A:
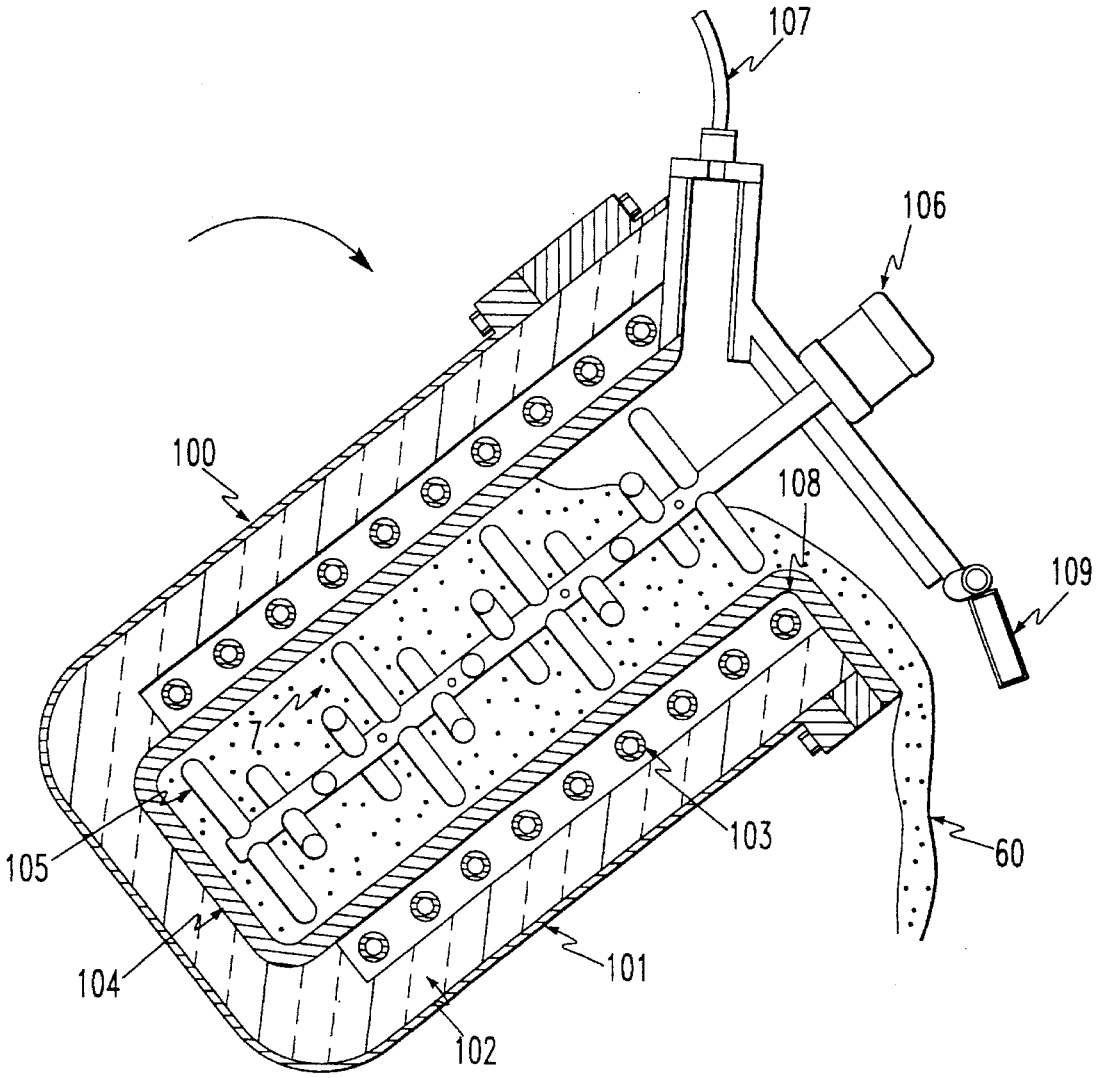
Figure 7C:
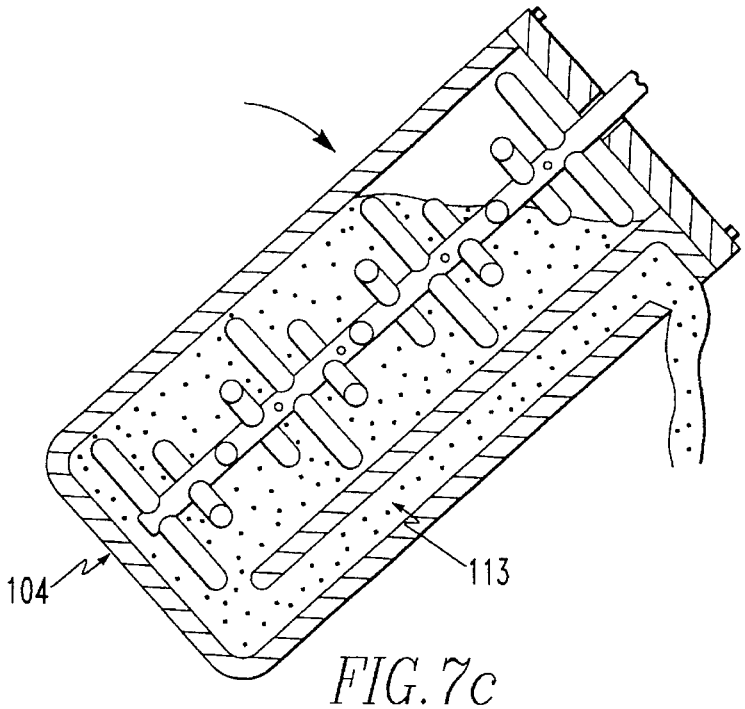

FIG. 7*a* shows a stand-alone mixing apparatus 100 incorporating a pressure vessel 101, insulation 102, heating elements 103, mixing column 104, a stirring rod with blades 105 connected to a mixing motor 106, an input feed 107 through which inputs 28 may be added, or vacuum or gas supplied. The vessel 101 also includes a pouring spout 108 and a pressure door 109. Composite material 7 is produced inside the mixing apparatus 100. The pressure door 109 may be closed during the mixing such that the mixing may occur in a vacuum, nitrogen, or inert atmosphere. After mixing, the vessel 101 may be tilted as shown in FIG. 7*a* and the pressure door 109 opened such that the composite material 7 is poured out as output 60. FIG. 7*a* shows composite material 7 being poured off the top of the mixing column 104. However, composite mixture 7 may be supplied from the bottom by connecting the pouring spout 108 with a channel 113 to the bottom of the mixing column 104 while blocking material from flowing from the top of the mixing column 104 as shown in FIG. 7*c*.

FIG. 7*b* shows another embodiment of a stand-alone continuous composite mixing unit 110 incorporating many of the same features as the unit in FIG. 7*a*, except that gas supplied through an inlet 36 is used to force composite mixture 7 through a supply tube 111 to provide output 60. Vacuum may also be drawn through inlet 36. Inputs 28 may be supplied through input feed lines 112 with the assistance of a gas to suspend the inputs 28 such that the inputs 28 provide the required volume to make-up composite material output 60 such that a continuous composite mixture 7 can be provided as required.

Figure 7D:
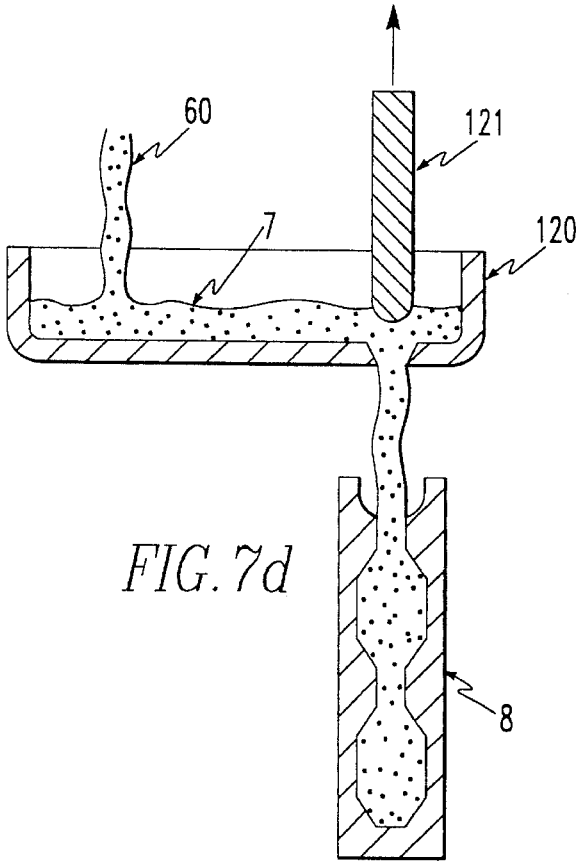

FIG. 7*d* shows the output 60 of the mixing device 13 feeding into a supply reservoir 120 which may incorporate stirring action to keep the particles suspended. If the input supply 60 is discontinuous, or the volume of each casting is more than the continuous supply input 60, the reservoir 120 may be used to accumulate composite mixture 7 such that the required output to fill molds 8 can be obtained. The flow from the reservoir 120 can be controlled through a valve or plunger 121.

Figure 8A:
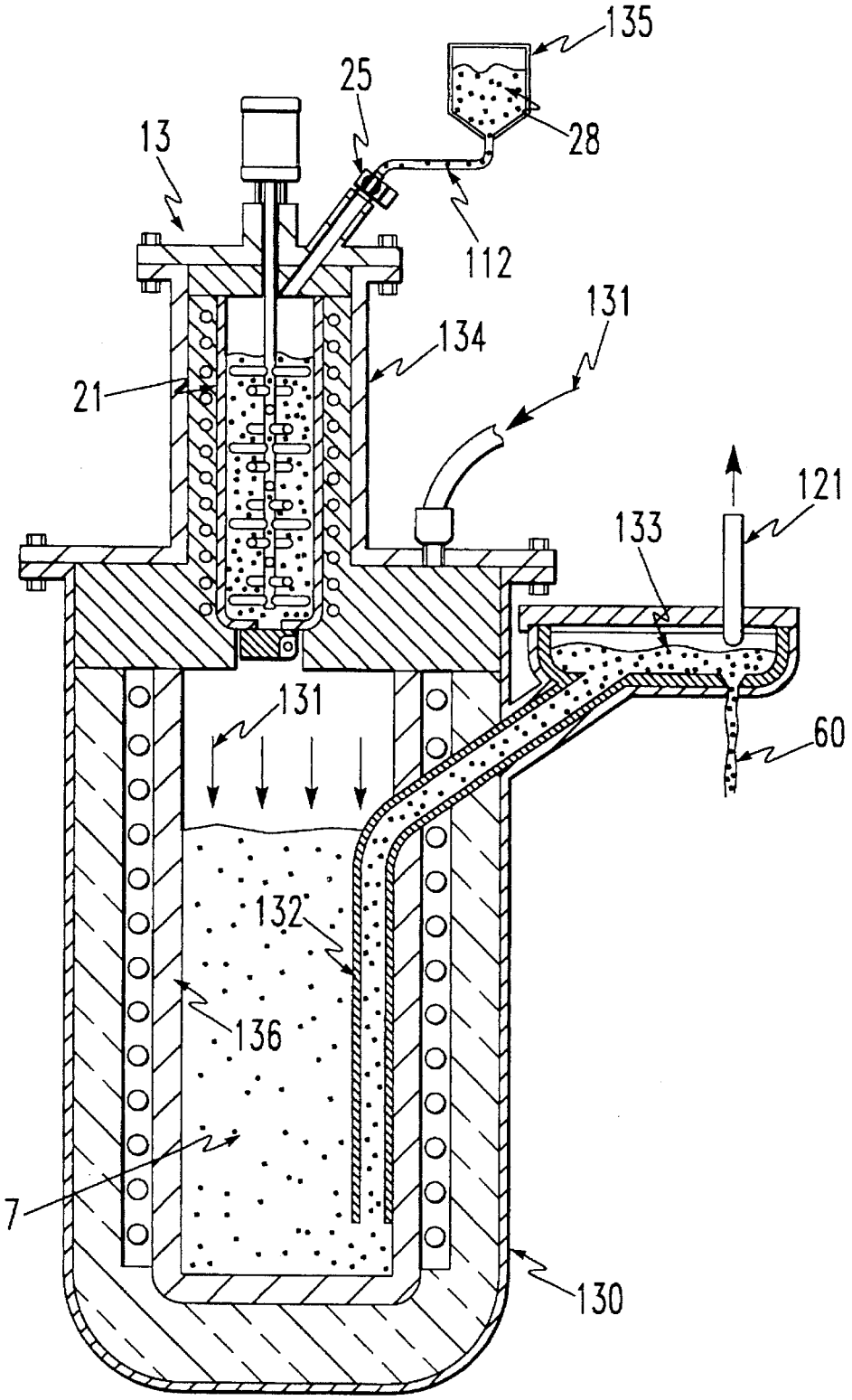
FIGS. 8*a* and 8*b* schematic representations showing continuous mixing and supply systems installed into pressure casting equipment.
Figure 8B:
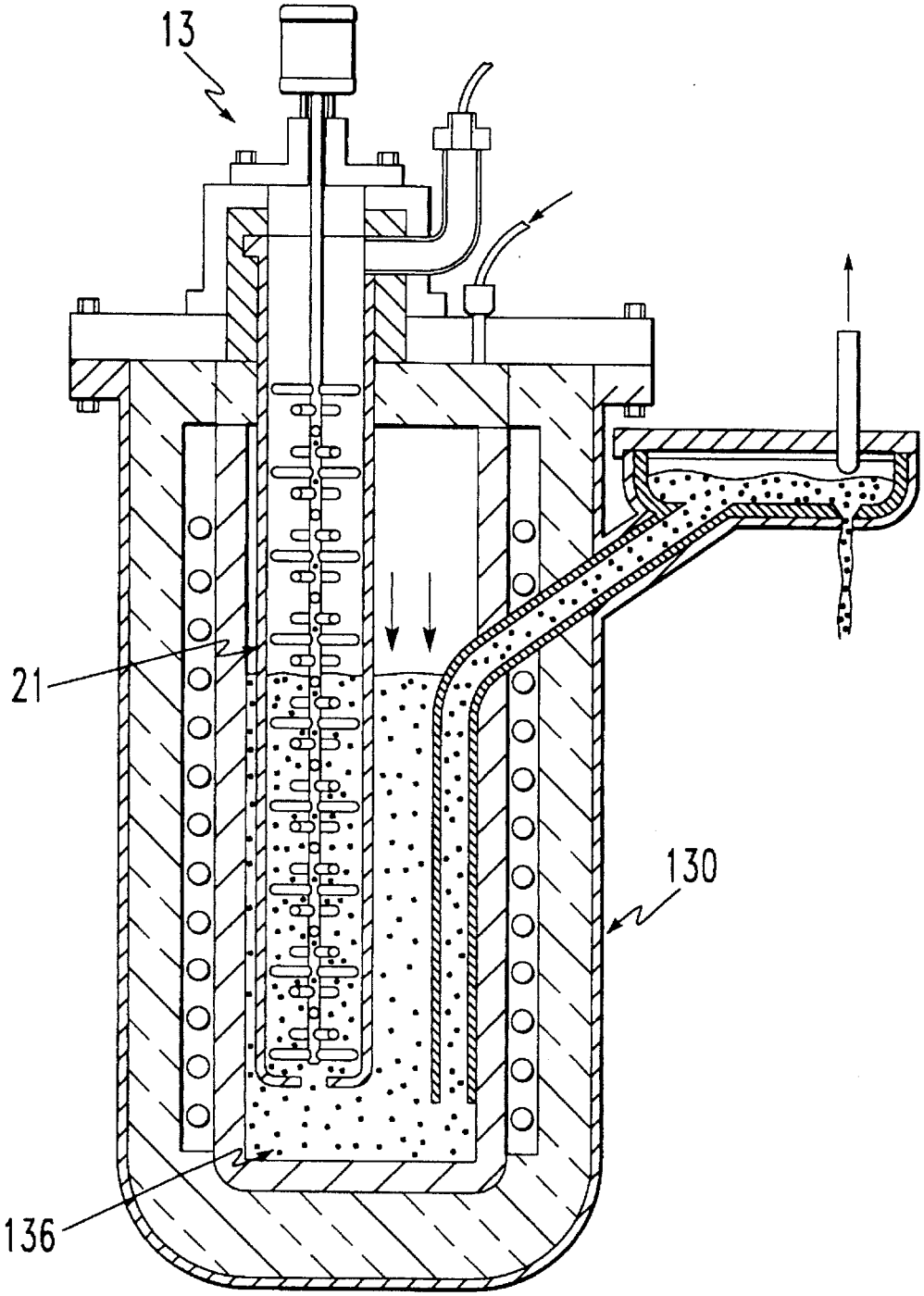

FIGS. 8*a* and 8*b* show pressure casting equipment made for casting unreinforced materials modified for casting low volume fraction composites. FIG. 8*a* shows a pressure casting machine 130 which uses inert gas 131 to force material inside the vessel 130 through a feed tube 132 into a reservoir 133 through a control valve 121 to produce an output 60. The pressure casting apparatus 130 has been modified to produce a composite mixture 7 and cast this mixture into molds (not shown). The pressure vessel 130 has been modified to include a new top head 134 which includes a mixing device 13 set-up as described in FIG. 1 with inputs 28 reservoirs 135. Inputs 28 flow through their respective supply line 112, through a control valve 25 and are mixed in the mixing column 21 and are fed into the pressure caster reservoir 136. The composite mixture 7 may be kept suspended by an additional stirring motor (not shown) or by inductive coupling which may be used to cause currents within the liquid composite mixture 7.

FIG. 8*b* shows a similar setup to FIG. 8*a* except that the mixing column 21 intrudes into the reservoir area 136 such that the output feeds directly into the reservoir 136.

Figure 9:
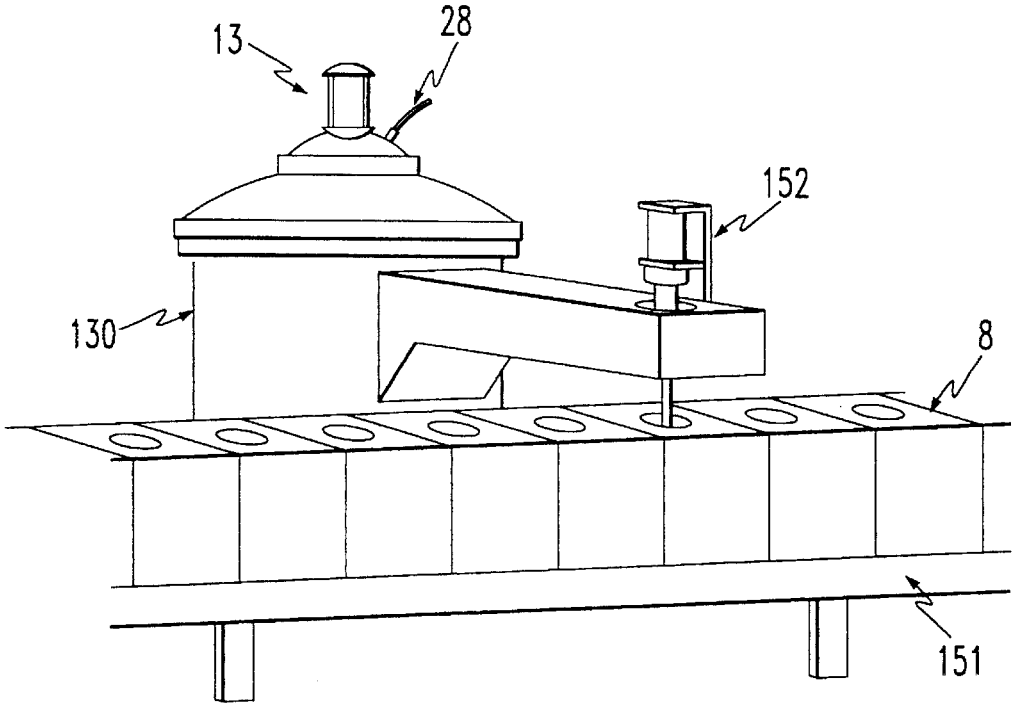
FIG. 9 is a schematic representation showing an outer view of a pressure caster with continuous composite supply mixer contained within.

FIG. 9 shows the outside view of a continuous pressure caster 130 with a composite mixing device attached to the top of the pressure caster 130 such that inputs 28 are fed into the mixing system 13 to produce a composite mixture 7 which is fed out of the pressure caster to fill molds 8 as they are positioned under the pressure caster 130 by a conveyer system 151. A plunger 152 is used to control the flow of composite mixture 7 out of the pressure caster 130 so that no overfilling occurs.

Figure 10:
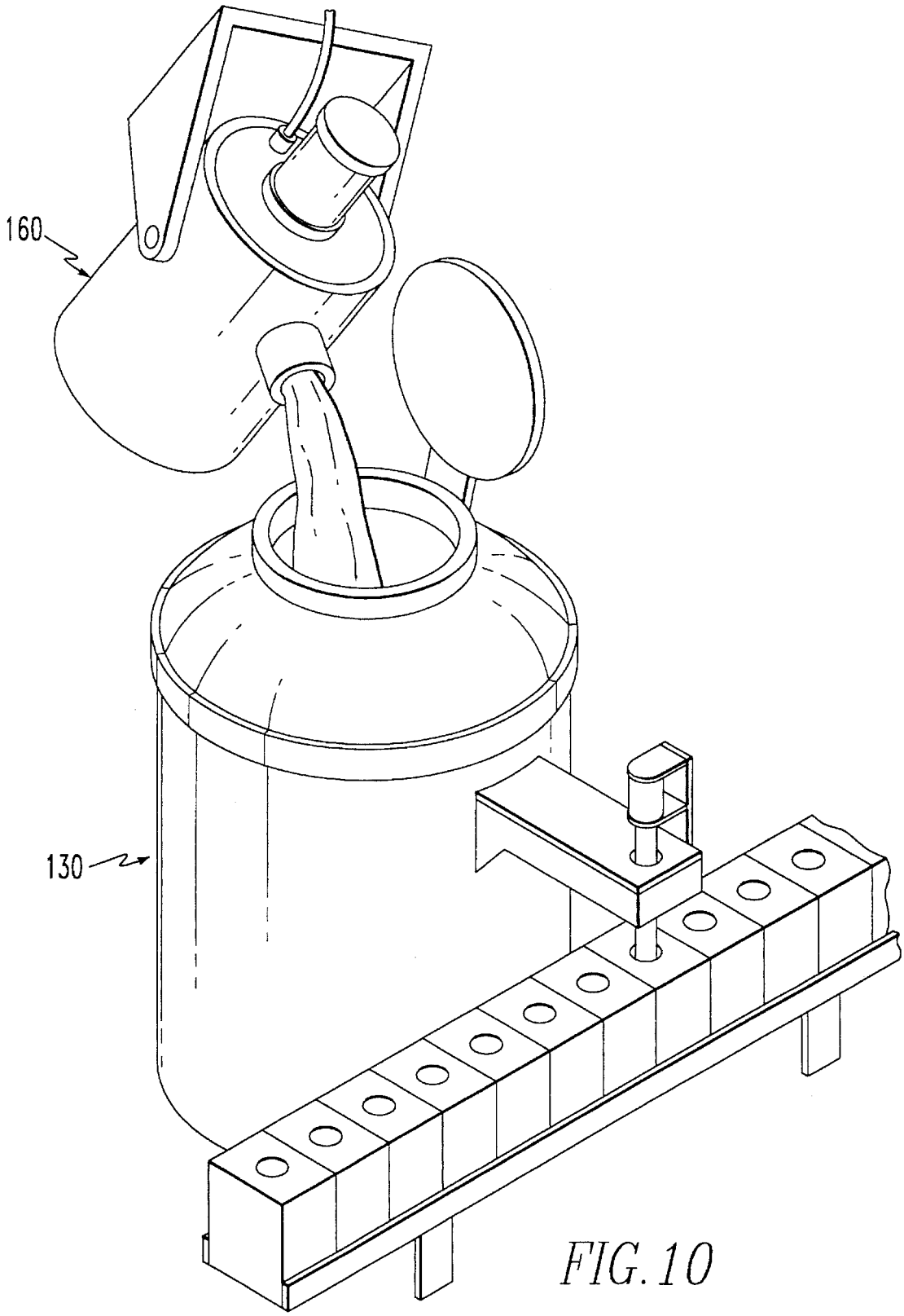
FIG. 10 is a schematic representation showing the filling of a pressure casting reservoir with a supply of low volume fraction mixed composite.

FIG. 10 shows another embodiment in which the pressure caster 130 is filled by a separate composite mixer 160 as required such that the pressure caster 130 can continuously cast components.

Figure 11:
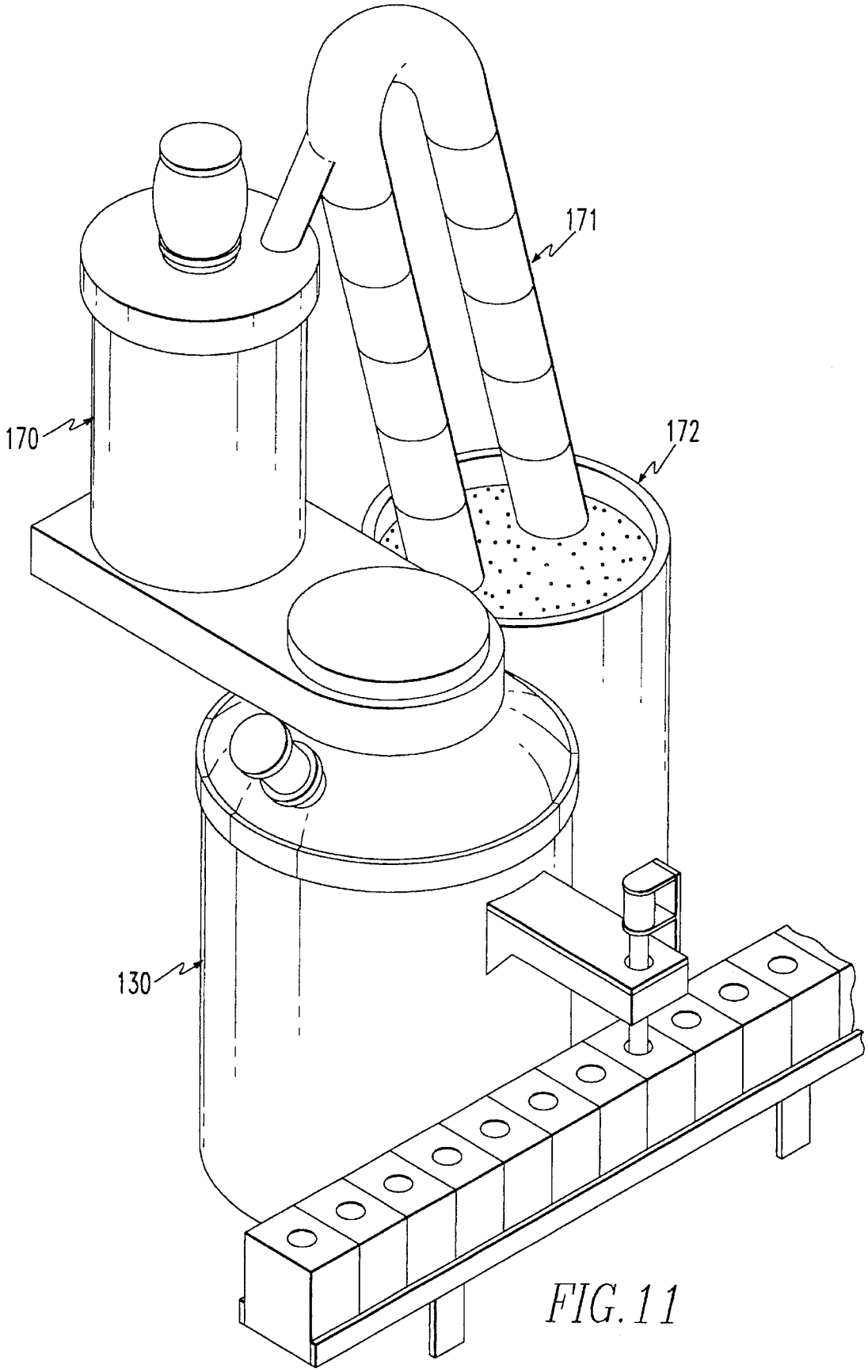
FIG. 11 is a schematic representation showing a pressure caster fitted with a composite mixer and automatic input supply feeder.

FIG. 11 shows another embodiment in which a pressure casting machine 130 is connected to a continuous mixing machine 170 which is fed by an automatic feeder system 171 from a material reservoir 172. This setup provides a continuous supply of composite mixture 7 to cast large volumes of components, such as automotive rotors, calipers, engine blocks, etc.

In the preferred embodiment, with reference to FIG. 1, A356 aluminum pellets 1 and 600 grit silicon carbide particulates 4 are fed in metered amounts such that for every 100 grams of aluminum, 20 grams of silicon carbide is fed in a vacuum into a ceramic lined mixing column heated to 650° C. by elements 11. As the aluminum pellets melt, the silicon carbide particles 4 are mixed into the molten aluminum 1 with a ceramic coated steel stirrer 6. The stirrer 6 is not turned on until the first load of aluminum melts in the column. After this aluminum melts, the stirrer 6 is rotated at 250 rpm for 10 minutes which causes the composite material 7 to be uniformly mixed. The plug 10 at the bottom of the column 3 is then opened to pour out mixed composite material 7. More unmixed material inputs are fed into the mixer 13 to replace the mixed composite material 7 that was fed out of the mixing column when no additional output is required, the plug 10 is closed and no more material is fed into the mixing column 3. The output is controlled such that the materials have at least 5 minutes of stirring to uniformly distribute the silicon carbide particles 4 before the mixed composite material exits 7 the mixing column.

A291 magnesium composite components may also be cast in the same way except that the vacuum is not normally used, argon is used instead.

To produce copper composites, the mixing column 3 is heated to 50° to 100° C. above the melting point of the alloy such as 1180° C. for pure copper. Alumina reinforcement is preferred over silicon carbide since the silicon in silicon carbide dissolves in molted copper. Iron or nickel composite may be formed by inductively heating the mixing column 3. The mixing stirrer 6 should be replaced with a solid ceramic rod to prevent melting or alloying that occurs at the higher temperatures required. Alumina and aluminum nitride reinforcements are preferred since they do not dissolve in molten iron or nickel alloys.

The matrix material 1 can be comprised of metal, polymer, an alloy of aluminum, an alloy of magnesium, an alloy of copper or an alloy of iron, to name but a few examples. The reinforcement material 4 can be comprised of ceramic, metal, carbon, silicon carbide, to name but a few examples. The composite components 9 can be used for wear parts, automotive rotors or automotive calipers.

Although the invention has been described in detail in the foregoing embodiments for the purpose of illustration, it is to be understood that such detail is solely for that purpose and that variations can be made therein by those skilled in the art without departing from the spirit and scope of the invention except as it may be described by the following claims.

What is claimed is:

1. A method for continuous production of a composite components comprising the steps of:

providing continuously desired amounts of reinforcement material and matrix material to a mixing device heated above the melting point of the matrix material;

mixing reinforcement material into molten matrix material such that a composite material is formed having the reinforcement material uniformly dispersed therein; and feeding the composite material from the mixing device into a casting mold to produce a net shape composite component, where the desired amounts of reinforcement material and matrix material provided to the mixing device match the amount of the composite material fed into the casting mold from the mixing device.

2. A method as described in claim 1 wherein the feeding step includes the steps of transferring mixed composite material to a pressure casting device and pressure casting the composite material into a mold.

3. A method as described in claim 1 wherein the mixing step includes the step of circulating nitrogen gas through a stirring rod to remove gas bubbles and contaminates.

4. A method as described in claim 1 wherein before the mixing step, there is the step of evacuating the mixing device in a vacuum.

5. A method as described in claim 1 wherein the mixing step includes the step of disposing reinforcement material and matrix material into a mixing device heated above the melting point of the matrix material.

6. A method as described in claim 5 wherein the feeding step includes the step of directly feeding the composite material from the mixing device into a casting mold.

7. A method as described in claim 5 wherein the disposing step includes the step of automatically providing metered proportions of the reinforcement material and matrix material to the mixing device based on an amount of mixed composite material removed from the mixing device.

8. A method as described in claim 5 wherein the disposing step includes the step of inputting particles of reinforcement and a liquid matrix.

9. A method as described in claim 5 wherein the disposing step includes the step of inputting particles of reinforcement and solid pellets of matrix material.

10. A method as described in claim 5 wherein before the feeding step, there is the step of supplying the composite material from the mixing device into a reservoir such that the reservoir can provide a continuous supply of composite material.

11. A method as described in claim 10 wherein the feeding step includes the step of filling a casting mold with composite material from the reservoir.

12. A method as described in claim 5 wherein the disposing step includes the step of inputting reinforcement material in the form of agglomerated particles and the mixing step breaks up the agglomerated particles such that the reinforcement material becomes uniformly dispersed in the matrix.

13. A method as described in claim 12 wherein the agglomerated particles include other material besides the reinforcement which change the composition of the matrix material.

14. A method as described in claim 5 wherein the disposing step includes the step of inputting agglomerates of solid matrix material and reinforcement material particles premixed to a desired composition.

15. A method as described in claim 14 wherein after the inputting step, the mixing step causes the solid matrix material to melt and the reinforcement particles are uniformly dispersed and mixed.

16. A method as described in claim 5 wherein the disposing step includes the step of providing the reinforcement material and matrix material through inlets of the mixing device and the feeding step includes the step of removing the composite material through an outlet of the mixing device as the inlets provide material.

17. A method as described in claim 16 wherein the mixing step occurs in a mixing container having a stir mechanism such that unmixed reinforcement and matrix materials are added to a first end of the mixing container and uniformly mixed composite material is available from a second end of the mixing container.

18. A method as described in claim 17 wherein the feeding step is controlled such that composite material flowing through the mixer has sufficient time to be uniformly dispersed during feeding.

19. A method as described in claim 17 wherein the mixing step incorporates a stirring rod having mixing regions which mix the composite material in varying degrees.

20. A method as described in claim 17 wherein the removing step causes the composite material to move through the mixing container.

21. A method as described in claim 20 wherein reinforcement and matrix material to be mixed in the mixing container is moved through the mixing container due to gravity.

22. A method as described in claim 20 wherein reinforcement and matrix material to be mixed in the mixing container is moved through the mixing container due to forces induced by stirring.

23. A method as described in claim 20 wherein reinforcement and matrix material to be mixed in the mixing container is moved through the mixing container due to gas pressure in the mixing container.

24. A method as described in claim 23 wherein the stirring mechanism comprises a tube and during the removing step, the composite material is removed from the mixing device through the tube.

25. A continuous composite casting system comprising:

a providing mechanism for providing a continuous supply of liquid composite material;

a casting device for forming the liquid composite material from the providing mechanism into a net-shape composite component, and a matching mechanism for matching amounts of reinforcement material and matrix material supplied into the providing mechanism with a desired amount of the composite material fed into the casting mold.

26. A system as described in claim 25 wherein the providing mechanism comprises a mixing device having inlets providing reinforcement and matrix material and an outlet for supplying a continuous supply of composite material.

27. A system as described in claim 26 wherein the casting device comprises a plurality of molds disposed on a conveyor mechanism such that each of the molds in turn can be selectively positioned in fluidic communication with the outlet to continuously form composite components.

* * * * *